United States Patent [19]

Dufour

[11] Patent Number: 4,883,097

[45] Date of Patent: Nov. 28, 1989

[54] PAPERMAKERS WET FELTS

[75] Inventor: Marcel Dufour, Sryrieix, France

[73] Assignee: Asten Group, Inc., Charleston, S.C.

[21] Appl. No.: 904,028

[22] Filed: Sep. 4, 1986

Related U.S. Application Data

[63] Continuation of Ser. No. 357,014, Mar. 11, 1982.

[30] Foreign Application Priority Data

Mar. 11, 1981 [FR] France ..... 81 04839

[51] Int. Cl.[4] ..... D21F 7/08; D03D 1/00

[52] U.S. Cl. ..... 139/383 A; 139/420 R; 139/425 A; 162/DIG. 1; 162/358; 428/234; 428/253

[58] Field of Search ..... 139/383 A, 425 A, 420 R, 139/420 A, 426; 162/DIG. 1, 348, 358, 359; 428/234, 235, 253; 66/87, 94, 169, 170, 190, 195; 34/116, 123, 243 R

[56] References Cited

U.S. PATENT DOCUMENTS

| | | | |
|---|---|---|---|
| 2,006,275 | 6/1935 | Meiwald | 66/169 R |
| 2,064,074 | 12/1936 | McNamee | 139/420 R |
| 2,968,085 | 1/1961 | Matthews . | |
| 3,158,984 | 12/1964 | Butler | 139/383 A |
| 3,279,504 | 10/1966 | Wagner | 139/419 |
| 3,728,876 | 4/1973 | Richard et al. . | |
| 3,948,722 | 4/1976 | Wheeldon et al. . | |
| 4,007,611 | 2/1977 | Blezard | 66/169 R |
| 4,141,388 | 2/1979 | Romanski | 139/383 A |
| 4,290,209 | 9/1981 | Buchanan et al. | 139/383 A |
| 4,356,225 | 10/1982 | Dufour | 428/234 |
| 4,361,618 | 11/1982 | Dufour et al. | 428/234 |
| 4,502,513 | 3/1985 | Müller | 139/383 R |

FOREIGN PATENT DOCUMENTS

| | | | |
|---|---|---|---|
| 668242 | 8/1963 | Canada . | |
| 782761 | 4/1968 | Canada . | |
| 652873 | 11/1937 | Fed. Rep. of Germany | 66/169 |
| 2111320 | 10/1971 | Fed. Rep. of Germany . | |
| 2213421 | 10/1973 | Fed. Rep. of Germany . | |
| 790861 | 9/1980 | Finland . | |
| 539899 | 4/1922 | France . | |
| 1109424 | 9/1955 | France . | |
| 1557944 | 1/1969 | France . | |
| 219139 | 7/1924 | United Kingdom | 139/420 R |
| 708936 | 5/1954 | United Kingdom . | |
| 1220531 | 1/1971 | United Kingdom | 139/383 A |

OTHER PUBLICATIONS

German Reference "Myers Lexikon der Technik und der exalsten Natur Wissenschaften", vol. 2, pp. 1695–1697.

*Albany Felt Fabric and Facts,* Albany Felt Company, Albany, N.Y. 12201, Jul./Aug. 1977.

*Primary Examiner*—James Kee Chi

*Attorney, Agent, or Firm*—Volpe and Koenig

[57] ABSTRACT

Papermaker's felt employing compressible knit yarn in a woven base to provide a durable resiliency so as to provide vibration dampening and delay the occurrence of crushing during papermaking.

9 Claims, 2 Drawing Sheets

PAPERMAKERS WET FELTS

This is a continuation of application Ser. No. 357,014, filed Mar. 11, 1982.

The present invention relates to felts or paper machine clothing which are used for conveyor belts and filtration belts on papermaking machines.

Papermaking machines which continuously process paper into pulp have three sections:

The first section is for the formation of an aqueous sheet by water filtration,

The second section is for the dewatering of the wet sheet by water extraction, and The third section is for the drying of the sheet by airsteam filtration.

At each stage of this process, conveyor belts or similar items are utilized to form, press, dry. These belts are conventionally made from felts or paper machine clothing which may be comprised of a weaved base with a needle batt on one or two faces.

The main function of the felt belts is to transport the wet paper sheet and to allow water removal by running the sheet between appropriate devises and then, after water is mostly removed, the sheet is run on heated cylinders to facilitate its drying. This is done by increasing the cylinder heat transfer towards the sheet and by creating a spontaneous ventilation to facilitate evaporation and absorption of a certain quantity of water content.

The wet paper, supported on the wet felt belt, is squeezed as it passes through the nip of the machine to facilitate water removal therefrom. In time, the felt becomes matted and its thickness decreases as it is continuously passed through the nip. Generally, when the felts are not damaged, there exists a theoretical thickness limit EL at the machine nip below which the wet end paper clothing cannot function. If this EL thickness limit is surpassed some crushed areas appear in the felt which will be indicated hereafter by "crushing". The EL thickness limit is the result of three factors:

eF theoretical felt thickness reduced to a homogeneous unit, (i.e., no free void volume)

ee thickness corresponding to the quantity of water carried by the felt, ef corresponding to the thickness of the paper sheet with water content.

Accordingly, $EL = eF + ee + ef$.

Not only does papermaking become problematic because of the occurrence of crushing, but it was found that the machine rolls and cylinders were submitted to vibrations harmful to the quality of the sheet obtained as the thickness in the nip approaches the limit EL.

It is an object of the present invention to provide a felt for papermachine clothing comprised of a permeable fabric having warp yarns interlaced with weft yarns, some of which are knitted compressible yarns, in order to give to the felt additional cushioning to dampen vibrations between the rolls and cylinders of the paper machine and delay the occurrence of crushings.

Other objects and advantages of the present invention will become apparent from the following portion of the of the specification and from the accompanying drawings which illustrate, in accordance with the mandate of the patent statutes, a presently preferred embodiment incorporating the principals of the invention.

Figure 1:
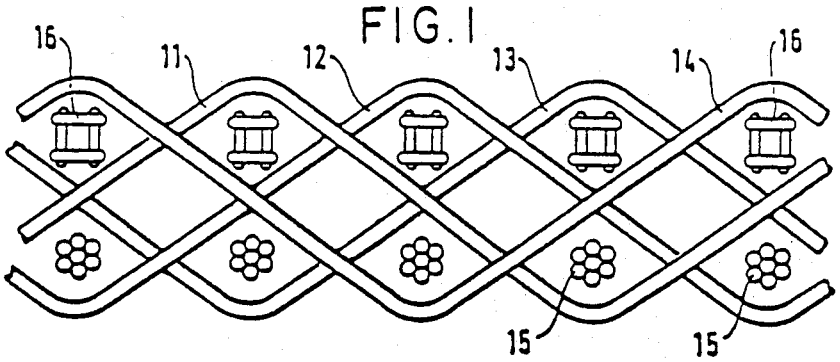
FIG. 1 is a CMD section view of a base woven with 2 warps in accordance with the teachings of the present invention.

FIG. 1 represents a water permeable fabric made of weft yarns 11, 12, 13, 14 and two layers of warp 15, 16. The weft yarns are monofilament yarns. The warp yarn layer 15 is comprised of incompressible cabled yarns. The yarn 16 of the other warp layer is comprised of knitted compressible cabled yarns, for instance yarns with stitches as shown in FIG. 3.

Figure 2:
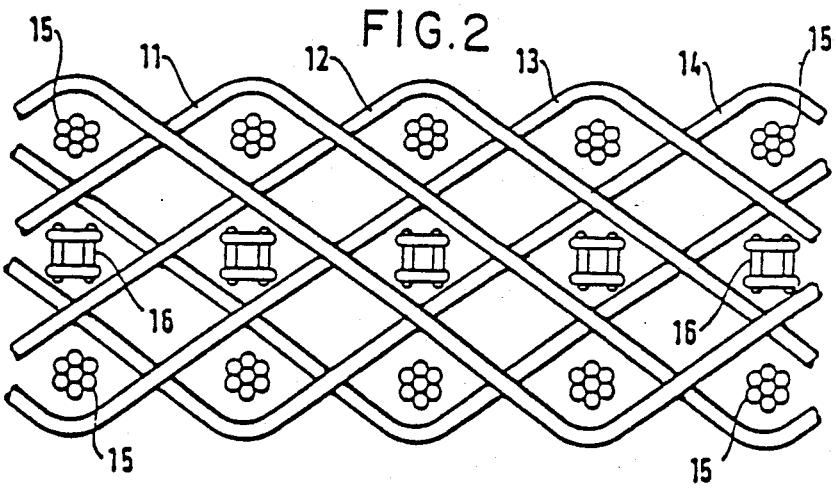
FIG. 2 is a CMD section view of a base woven with 3 warps.

FIG. 2 represents a variation of fabric comprised of monofilaments weft yarns 11, 12, 13, 14 and 3 layers of warp yarns 15, 16. The two layers of warp yarn 15 are comprised of noncompressible cables yarns. The warp yarn 16 of the middle layer is comprised of compressible knitted cabled yarns. The compressible layer 15 is thus inserted between 2 noncompressible layers 15.

The noncompressible layers provide longitudinal strength. The use of compressible yarns in the felt gives it a certain resiliency and shock absorption effect, moreover preserving its resistance to wear, its permeability and its absorption quality.

Figure 3:
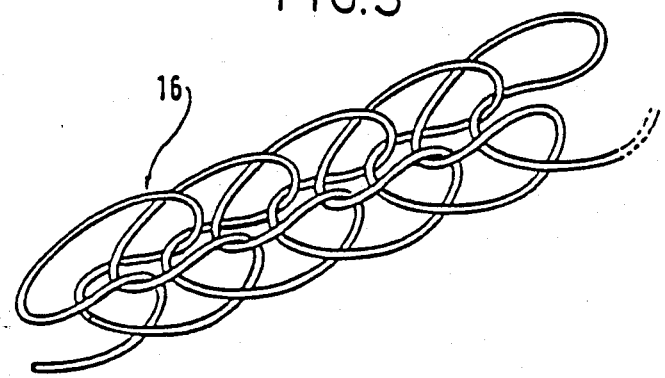
FIG. 3 is an enlarged perspective view of a compressible knitted yarn.

In the preferred embodiment, the weft and warp yarns are made of synthetic fibers and the compressible knitted yarn is formed of a monofilament to better preserve its shape and knitted in such a manner as to constitute a basic string of compressible elements (FIG. 3). Alternatively, the compressible yarn can be comprised of a supporting core and one or many knitted yarns coiled up around the supporting core. Also, the knitted yarns may be made from synthetic or metallic multifilments.

It is desirous to incorporate the knitted yarns into the fabric without constricting its volume. Preferably knitted yarns longer than the felt are utilized in the weave; this allows the yarn to work without tension and the knitted yarn stitches to keep their shape for the purpose of obtaining maximum shock absorption. Also, the knitted yarn can be chemically treated before weaving, such as being coated with resin, to increase its resistance to unraveling.

Figure 4:
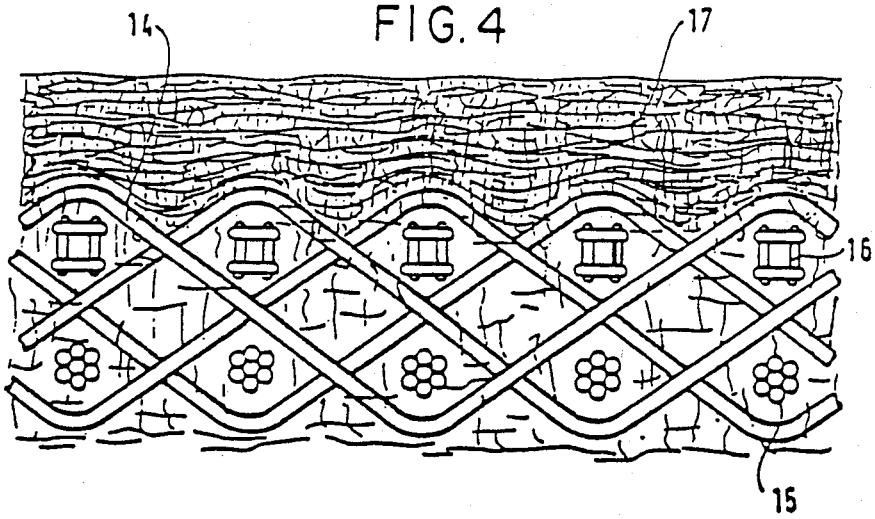
FIG. 4 is a sectional view of the base fabric of FIG. 1 overlaid with a needled fiber batt.
Figure 5:
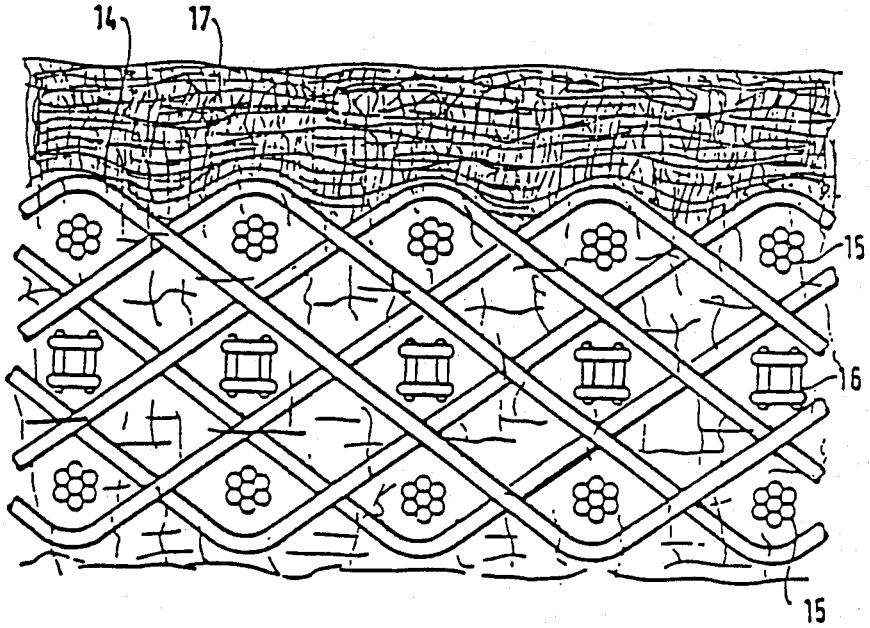
FIG. 5 is a sectional view of the base of FIG. 2 overlaid with a fiber batt.

As shown in FIGS. 4 and 5, a batt of fiber 17 is anchored to the respective bases by a conventional needling technique to give the felt a smooth and nonmarking surface to avoid the risk of paper marking. The fibers of batt 17 are anchored partly in the base fabric and form a batt of 4 to 5 mm on top of the base.

Felt incorporating the teachings of the present invention may be used in all three stages of papermaking as follows:

1. Forming fabrics for the Fourdrinier wire section,
2. Wet felts for the press section, and
3. Dryer felts for dryer sections.

Such felts are particularly advantageous when used on the wet end, since felts having compressible knitted yarns have the following advantages for papermaking:

1. Elimination or postponement of crushing, i.e. the point at which the felt is, compacted and has reached the minimum thickness permitted for its functioning.
2. Maximum water handling; and 3. Shock absorption for diminishing or suppressing vibrations.

Knitted or cabled yarn of square section or the like present a certain rigidity. Paper machine felts employing knitted yarns yield a more compressible felt which can act as shock absorption between the rolls of the paper machine. The utilization of felts weaved with knitted yarns in a permanent or progressive incompressible structure bring about a permanent difference in the thickness of the free base fabric and the compressed base fabric (i.e., when in the machine nip). This thickness will vary in accordance with the position considered in the wet section and will be greater for the first positions, less for the last positions. The thickness difference may be varied in accordance to the dryness desired for the sheet.

The resiliency obtained from the utilization of cabled or knitted yarn assures a good sheet handling, sufficient for good dryness and good life.

The compressible yarns may be introduced in the felts as either warp or weft yarns. In fact, in the example given one could replace the noncompressible warp yarn by compressible cabled yarns for the purpose of easier fabrication. However, one could also utilize compressible yarns for the weft yarns or even insert compressible yarns both in the warp and the weft yarns. Also, one could utilize only knitted yarns both in the warp and weft yarns.

What is claimed is:

1. A shock absorbing, vibration suppressing fabric for transporting a paper sheet in a papermaking machine having at least one roller nip through which the paper sheet must be transported, said fabric having at least two systems of yarns interwoven in a repeat pattern with at least one of said systems having compressible knitted yarns interwoven with at least one of said systems having longitudinally extending incompressible yarns, said compressible yarns being under less tension than said monofilament yarns so that the entire fabric is compressible and has a thickness limit EL which is defined by the equation $EL=eF+ee+ef$, wherein eF is the theoretical thickness reduced to a homogeneous unit, ee is the thickness corresponding to the quantity of water carried by the fabric and ef corresponds to the thickness of the paper sheet.

2. The fabric of claim 1 wherein the fabric is comprised of at least three systems of yarns with said knitted compressible yarns being interwoven with and non-parallel to said longitudinally extending incompressible monofilament yarns.

3. The fabric of claim 1 wherein the fabric is comprised of at least three systems of yarns with at least one system of incompressible yarns and one system of compressible knitted yarns extending in the same direction with the respective yarns thereof being generally parallel to each other.

4. The fabric according to claim 1 wherein the fabric further comprises a batt needled to the paper carrying surface.

5. The fabric of claim 1 wherein the compressible knitted yarns are monofilaments.

6. The fabric of claim 1 wherein the compressible knitted yarns are comprised of a basic string of three compressible elements.

7. The fabric of claim 6 wherein the compressible knitted yarns are monofilaments.

8. A shock absorbing, vibration suppressing fabric for use in transporting a wet paper sheet through a roller nip of a papermaking machine, said fabric having at least two systems of yarns interwoven in a repeat pattern with at least one of said systems having compressible knitted yarns and at least one of said systems having incompressible yarns, said compressible yarns being under less tension than said incompressible yarns so that the entire fabric is compressible and has a thickness limit EL which is defined by the equation $EL=eF+ee+ef$, wherein eF is the theoretical fabric thickness reduced to a homogeneous unit, ee is the thickness corresponding to the quantity of water carried by the fabric and ef corresponds to the thickness of the wet paper sheet.

9. An improved wet press felt for use in transporting wet paper as it is passed through the nip of a papermaking machine to remove water from the wet paper, the improved felt comprised of interwoven warp and weft yarns with at least certain of said yarns being compressible knitted yarns, and the felt having a thickness limit EL which is defined by the equation $EL=eF+ee+ef$, wherein eF is the theoretical felt thickness reduced to a homogeneous unit, ee is the thickness corresponding to the quantity of water carried by the felt, and ef corresponds to the thickness of the paper sheet with water content.

* * * * *

UNITED STATES PATENT AND TRADEMARK OFFICE

CERTIFICATE OF CORRECTION

PATENT NO. : 4,883,097

DATED : November 28, 1989

INVENTOR(S) : Marcel Dufour

It is certified that error appears in the above-identified patent and that said Letters Patent is hereby corrected as shown below:

Column 1, line 11, delete the word "The" first occurrence and insert therefor --A--.

Column 1, line 11, delete the word "is".

Column 1, line 13, delete the word "The" first occurrence and insert therefor --A--.

Column 1, line 13, delete the word "is".

Column 1, line 15, delete the word "The" first occurrence and insert therefor --A--.

Column 1, line 15, delete the word "is".

Column 1, line 18, after the word "press," and before the word "dry" insert --and--.

Column 1, line 20, delete the word "weaved" and insert therefor --woven--.

Column 1, line 21, delete the words "needle batt" and insert therefor --needled batt--.

Column 1, line 21 delete the word "two" and insert therefor --both--.

UNITED STATES PATENT AND TRADEMARK OFFICE

CERTIFICATE OF CORRECTION

PATENT NO. : 4,883,097

DATED : November 28, 1989

INVENTOR(S) : Marcel Dufour

It is certified that error appears in the above-identified patent and that said Letters Patent is hereby corrected as shown below:

Column 1, line 22, delete the word "function" and insert therefor --functions--.

Column 1, line 22, delete the word "is" and insert therefor --are--.

Column 1, line 23, delete the word "and" and insert therefor --,--.

Column 1, line 25, after the word "removed," and before the word "the" insert --to run--.

Column 1, line 25, delete the words "is run".

Column 1, line 26, delete the word "This" and insert therefor --Drying--.

Column 1, line 32, delete the word "The" first occurrence, and insert therefor --During the dewatering phase, the--.

Column 2, line 2, delete the "2" and insert therefor --two--.

Column 2, line 25, delete the "2" and insert therefor --two--.

Column 2, line 66, after the word "is" and before the word "compacted" delete the ",".

UNITED STATES PATENT AND TRADEMARK OFFICE
CERTIFICATE OF CORRECTION

PATENT NO. : 4.883.097

DATED : November 28, 1989

INVENTOR(S) : Marcel Dufour

It is certified that error appears in the above-identified patent and that said Letters Patent is hereby corrected as shown below:

Column 2, line 67, after the word "functioning" delete the "." and insert therefor --;--.

Signed and Sealed this

Nineteenth Day of March, 1991

*Attest:*

HARRY F. MANBECK, JR.

*Attesting Officer*

*Commissioner of Patents and Trademarks*